US012012700B2

(12) United States Patent
García

(10) Patent No.: US 12,012,700 B2
(45) Date of Patent: Jun. 18, 2024

(54) MODULAR FASTENING FOR RAILWAY CROSSINGS

(71) Applicant: PANDROL IBERICA S.A.U., Barcelona (ES)

(72) Inventor: Rubén Ripoll García, Barcelona (ES)

(73) Assignee: PANDROL IBERICA S.A.U., Barcelona (ES)

( * ) Notice: Subject to any disclaimer, the term of this patent is extended or adjusted under 35 U.S.C. 154(b) by 814 days.

(21) Appl. No.: 16/967,722

(22) PCT Filed: Feb. 5, 2018

(86) PCT No.: PCT/ES2018/070085

§ 371 (c)(1),
(2) Date: Aug. 5, 2020

(87) PCT Pub. No.: WO2019/149972

PCT Pub. Date: Aug. 8, 2019

(65) Prior Publication Data

US 2021/0040697 A1 Feb. 11, 2021

(51) Int. Cl.

| | |
|---|---|
| ***E01B 9/66*** | (2006.01) |
| ***E01B 7/28*** | (2006.01) |
| ***E01B 9/42*** | (2006.01) |
| ***E01B 9/48*** | (2006.01) |

(52) U.S. Cl.
CPC ..... *E01B 9/66* (2013.01); *E01B 7/28* (2013.01); *E01B 9/42* (2013.01); *E01B 9/483* (2013.01)

(58) Field of Classification Search
CPC ... E01B 7/28; E01B 9/42; E01B 9/483; E01B 9/66
See application file for complete search history.

(56) References Cited

U.S. PATENT DOCUMENTS 4,615,484 A * 10/1986 Kusko ..... E01B 9/685 238/154
2014/0231534 A1* 8/2014 Osler ..... E01B 9/62 238/287

* cited by examiner

*Primary Examiner* — Robert J McCarry, Jr.
(74) *Attorney, Agent, or Firm* — MARSHALL, GERSTEIN & BORUN LLP

(57) ABSTRACT

A modular fastening for track crossings includes a lower plate, an upper plate and an outer shoulder at each end of the plates, attached by means of adhesive bonding, which include means for anchoring the fastening on a surface. The upper plate includes a smooth central segment located between two grooved areas in correspondence with the ends of the upper plate. The present invention also includes two inner shoulders with lower grooves which can engage and fit into the grooved areas of the upper plate, where said inner shoulders include means for housing and securing an elastic fastening clip for fastening a railway rail.

9 Claims, 7 Drawing Sheets

MODULAR FASTENING FOR RAILWAY CROSSINGS

TECHNICAL FIELD OF THE INVENTION

The present invention relates to a modular fastening for track crossings which is applicable in the railway industry, and more specifically in the field of fastenings for track frog turnouts, allowing great versatility when using one and the same fastening for specific ranges of distances between rails, with the subsequent reduction in the costs for manufacturing and storing the fastenings required for covering an entire track frog segment.

BACKGROUND OF THE INVENTION

The track frog is a critical region of railway track crossing areas that is of great importance in turnout safety. The track frog corresponds with the central part of the crossing in which the rails come together to form a single rail, and it has the function of correctly guiding the wheels of the railway vehicle in the rail intersection or crossing.

Therefore, said area may have different rail profiles, gradients, clips and securing plate sizes, resulting in major problems occurring during switching operations.

Plates, referred to as frogs, comprising two inner shoulders that serve to fasten elastic rail securing clips are used today for securing or fastening rails in the track frog. One example is disclosed in Spanish Utility Model published under No. ES-1058662-U. The position of said inner shoulders in said plates is established in a predetermined manner according to the width of the rail. Therefore, the distance between the inner shoulders of a frog plate and the distance between consecutive or adjacent plates in the mentioned segment are different, which requires providing and using a wide range of plates with different distances between inner shoulders according to the distance required in each frog plate.

Frog plates usually comprise a metal bearing or lower plate, an upper plate, also of metal, and two anchoring end side shoulders. In the metal upper plate, there is a need to machine the edges, define the positioning of second shoulders, in this case inner shoulders, the position of which is determined according to the width and number of rails, make the corresponding boreholes, weld said second shoulders to the upper plate and finally subject the assembly formed by the upper plate, lower plate and end shoulders to a vulcanization or adhesive bonding phase, forming a fastening that is made as a single compact block on which fastening elements such as screws, nuts and clips are then arranged for fastening the rail.

In practice, three types of frog plates are commonly used according to their size, i.e., long, medium and short length type, which plates are obtained by casting and are subsequently vulcanized. In turn, each type of plate has a specific, predefined distance between the inner shoulders according to the position thereof in the track frog, with the drawbacks this entails in terms of production cost, storage cost and assembly complication.

On the other hand, there are situations in which a track requires the use of a reinforcement referred to as rolled iron or steel plate, consisting of a stiffening rod arranged between two tracks to provide greater stability, the positioning of which must also be defined, the corresponding holes made, welding carried out and the adhesive bonding with the aforementioned assembly performed.

The drawbacks of the frog plates described above include, among others, the fact that the processes for obtaining them are expensive and complex in terms of manufacturing operations. Additionally, they are subject to a plurality of variations in the positioning and the boreholes required for the elements involved, resulting in the need for multiple plate references according to the width and/or number of rails in this track frog segment.

DESCRIPTION OF THE INVENTION

The present invention relates to a modular fastening for track crossings which, by means of a sliding system that allows the longitudinal movement of the inner shoulders with respect to the upper plate, therefore in a direction transverse to the rail, for the variable positioning thereof at different distances, and with the capacity to be adapted and adjusted to the track requirements, preventing multiple plate references.

The modular fastening for track crossings proposed by the invention comprises a lower plate on which there is placed an upper plate, and an outer shoulder, located at each end of the plates, comprising means for anchoring the fastening on a support surface, where the plates and outer shoulders are attached by means of adhesive bonding, forming a single-block assembly.

According to the invention, the upper plate comprises a smooth central segment located between two grooved areas located in correspondence with the ends of the upper plate.

The fastening comprises two inner shoulders, which are independent parts, which in turn comprise lower grooves which can engage and fit into a plurality of positions on the grooved areas of the upper plate, where said inner shoulders comprise means for housing and securing an elastic fastening clip for fastening a railway rail by means of a coach screw. In other words, the lower grooves of the inner shoulders are suitable for engaging the grooves of the upper plate in multiple positions.

In turn, the smooth segment is suitable for placing in the upper portion thereof a base plate for the rail that furthermore serves as protection for said smooth segment, where the base plate can have dimensions different from the mentioned smooth segment, depending on the width requirements of the rail base.

According to a preferred embodiment, the lower plate and upper plate are metal plates.

It is contemplated for the upper plate to comprise a longitudinal channel running from one grooved area to the opposite grooved area and going through the smooth central segment to engage the inner shoulders. To that end, each inner shoulder comprises, on its inner face, a channel between the lower grooves acting like a guide bridge, where it may comprise a lower projection or protrusion suitable for being housed and moved in a guided manner along the longitudinal channel of the upper plate, and even suitable for acting as a safety end which acts as a stop in the movement of each inner shoulder.

According to the foregoing, it is contemplated for the smooth central segment of the upper plate to have a height greater than the height of the grooved areas, such that the lower end grooves of the shoulders engage the grooves of the upper plate, the lower bridge engages the walls of the longitudinal channel of the upper plate, and where appropriate, the lower projection of the shoulder is located inside said longitudinal channel, whereby preventing unwanted rotations of the shoulder.

The side face of the shoulders opposite the face on which housings are located for supporting the clip is the face that remains in contact with the sides of the upper base plate, regardless of whether it has smaller or larger dimensions, where the ends of said upper base plate may optionally have respective protrusions that enable fitting with the inner shoulders.

On one hand, it is contemplated for the smooth central segment of the upper plate to comprise on the upper portion thereof a base plate for the rail, where said base plate comprises two larger sides and two smaller sides, the length of each of the larger sides coinciding with the length of the smooth central segment of the upper plate.

On the other hand, it is contemplated for the smooth central segment of the upper plate to comprise on the upper portion thereof a base plate for the rail, where said base plate comprises two larger sides and two smaller sides, the length of the smooth central segment being smaller than the length of each of the larger sides of the base plate. In this case, the upper base plate does not have to be centered with respect to the smooth central segment of the upper plate, which allows for greater variability in terms of being adapted and adjusted to the track requirements.

In any case, it is contemplated for the smaller sides of the base plate to be drawn in with respect to the larger sides, defining respective fitting areas with respect to each of the inner shoulders.

The means for housing the elastic clip may comprise a longitudinal cavity made on one side of the inner shoulders for supporting the curved outer areas of the elastic clip, a central raised area in said longitudinal cavity separating the curved outer areas, serving as a lateral stop for these outer areas, as well as a central through hole for the screw for fastening the elastic clip to the rail and the actual inner shoulder to the upper plate.

Likewise, it is contemplated for the inner shoulders to comprise a prolongation surface which allows fastening a rolled iron or steel plate to the inner shoulder itself.

In this sense, for the case in which the rail requires using a rolled iron or steel plate, it is contemplated for the inner shoulders to have a geometry with the following variations:

- larger dimensions at the shoulders described above, such that it is prolonged after the face on which the cavities for housing the curved segments of the clip are located into a second surface of the same height as the upper face of the shoulders, where 5 holes are made, 4 for the passage of screws for fastening the rolled iron or steel plate to the shoulder itself and another central hole for the screw for fastening the assembly of the lower plate, shoulder and rolled iron or steel plate.
- the groove of the inner face of the shoulder is prolonged in this case to where the central hole is located, in which case it will not have the lower projection.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting manner.

PREFERRED EMBODIMENT OF THE INVENTION

Figure 1:
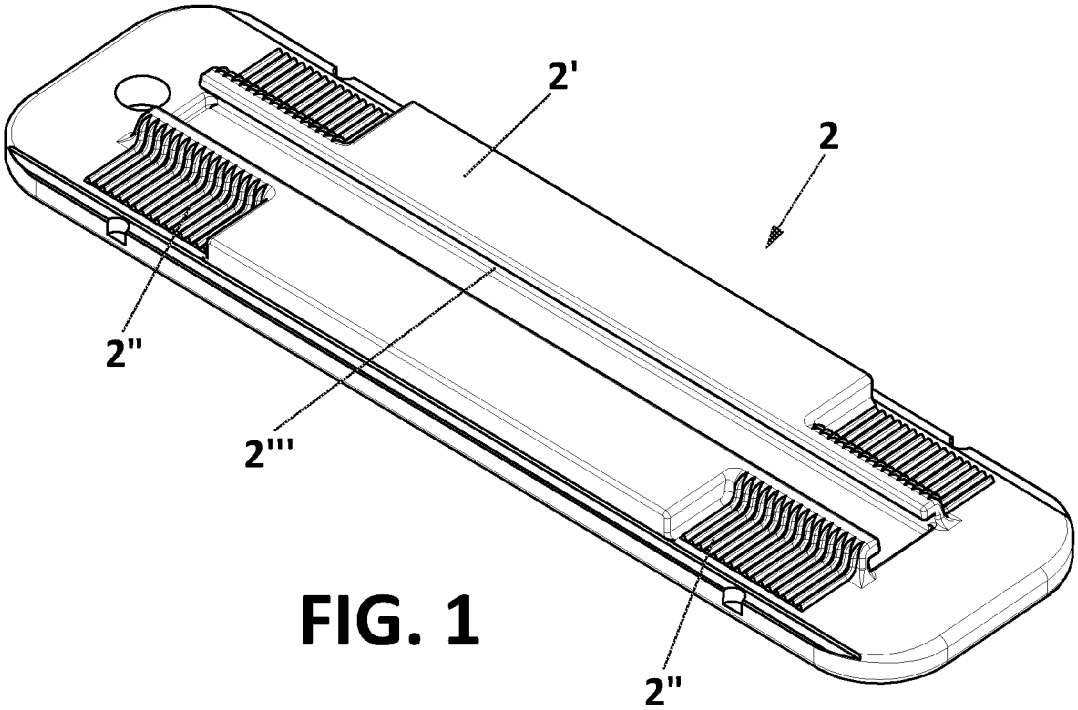
FIG. 1 shows a schematic perspective view of an embodiment of the upper plate comprised in the modular fastening of the invention.
Figure 2:
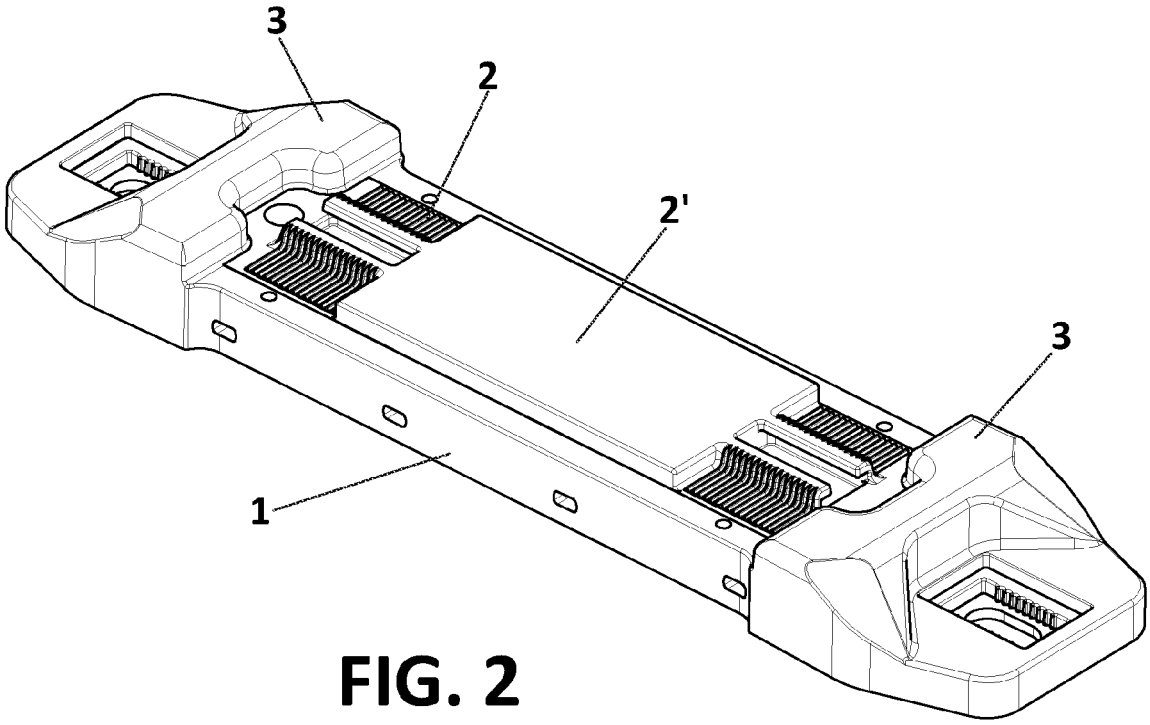
FIG. 2 shows a schematic perspective view of an embodiment of the fastening, in which the upper plate is attached by means of adhesive bonding to the lower plate and the end shoulders, an upper base plate additionally being depicted.

In view of the drawings that have been described, it can be seen how in one of the possible embodiments of the invention the modular fastening for track crossings proposed by the invention comprises a lower plate (1) on which there is placed an upper plate (2), both being made of metal, and an outer shoulder (3), located at each end of the plates (1, 2), comprising means for anchoring the fastening on a support surface (A), where the plates (1, 2) and the outer shoulders (3) are attached by means of adhesive bonding, forming a single-block assembly.

As can be seen in FIG. 1, the upper plate (2) comprises a smooth central segment (2') located between two grooved areas (2") located in correspondence with the ends of the upper plate (2).

Figure 3:
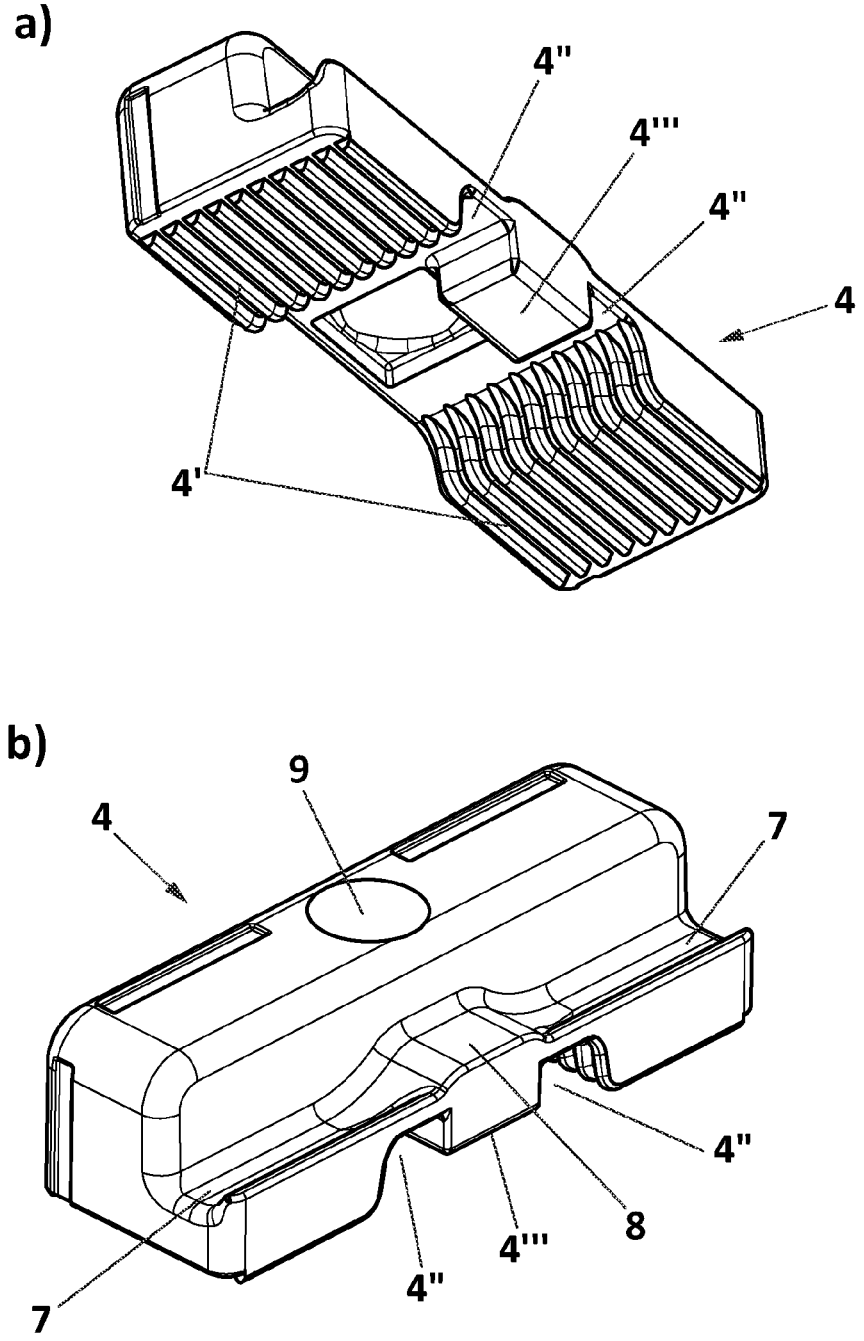
FIG. 3 shows two schematic perspective views, in which FIG. 3*a*) depicts a bottom perspective view and FIG. 3*b*) depicts a top perspective view of the inner shoulders comprised in the fastening of the invention.

The fastening comprises two inner shoulders (4), such as the one depicted in FIG. 3, which are independent parts that in turn comprise lower grooves (4') which can engage and fit into a plurality of positions on the grooved areas (2") of the upper plate (2), where said inner shoulders (4) comprise means for housing and securing an elastic fastening clip (B) for fastening a railway rail (C) by means of a coach screw. In other words, the lower grooves of the inner shoulders are suitable for engaging the grooves of the upper plate in multiple positions.

As can be seen in FIG. 1, the upper plate (2) comprises a longitudinal channel (2'") running from one grooved area (2") to the opposite grooved area (2") and going through the smooth central segment (2'), where the inner shoulders (4) comprise between the lower grooves (4') a guide bridge-like channel (4") and a lower projection or protrusion (4'") which can be housed in and moved in a guided manner along the longitudinal channel (2'") of the upper plate.

FIG. 1 shows that the smooth central segment (2') of the upper plate (2) has a height greater than the height of the grooved areas (2").

Figure 4:
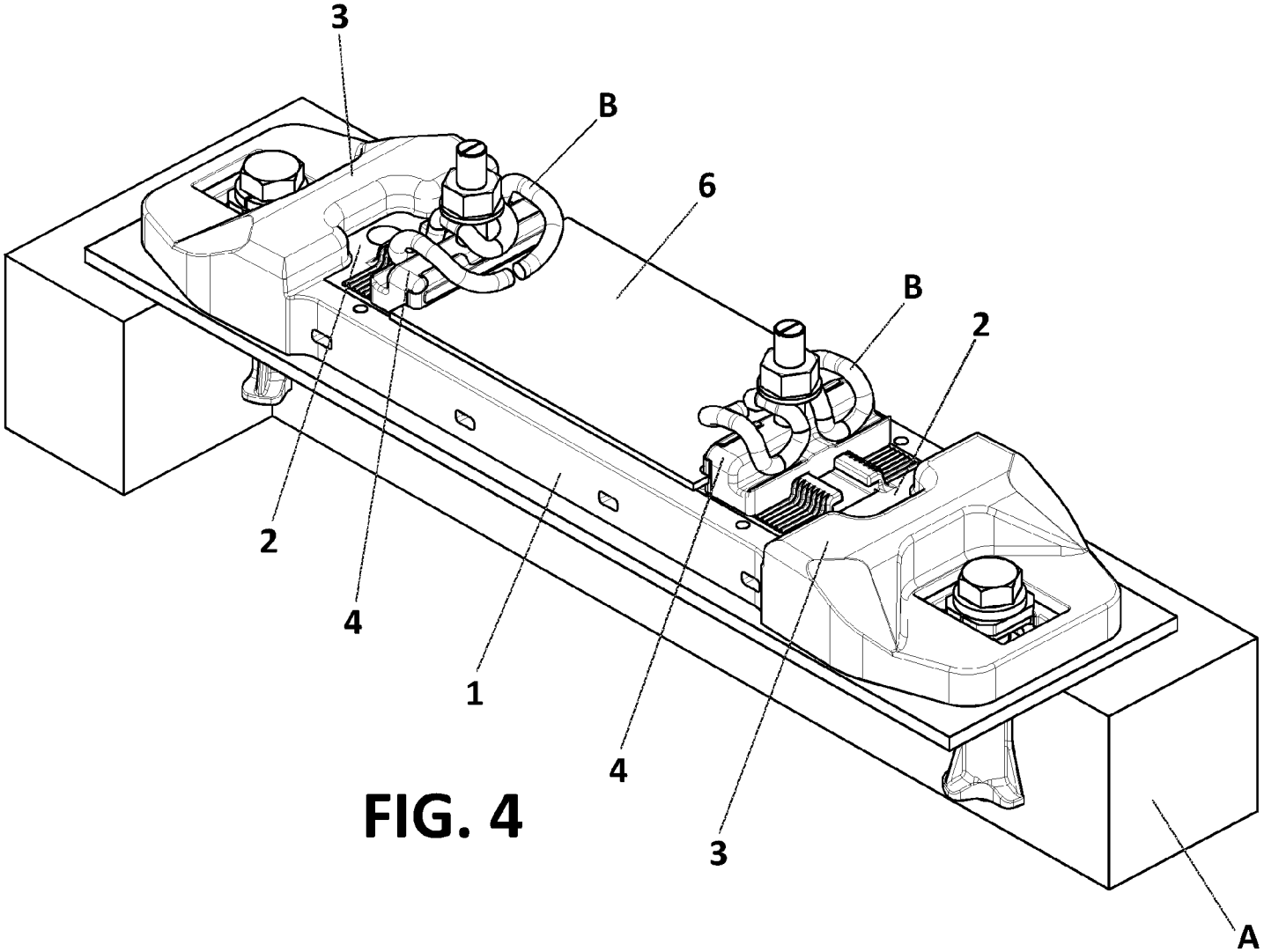
FIG. 4 shows a schematic perspective view of the embodiment of the modular fastening depicted in FIG. 2 in which the inner shoulders as well as the clips and coach screws for fastening the plate to a base are assembled.
Figure 5:
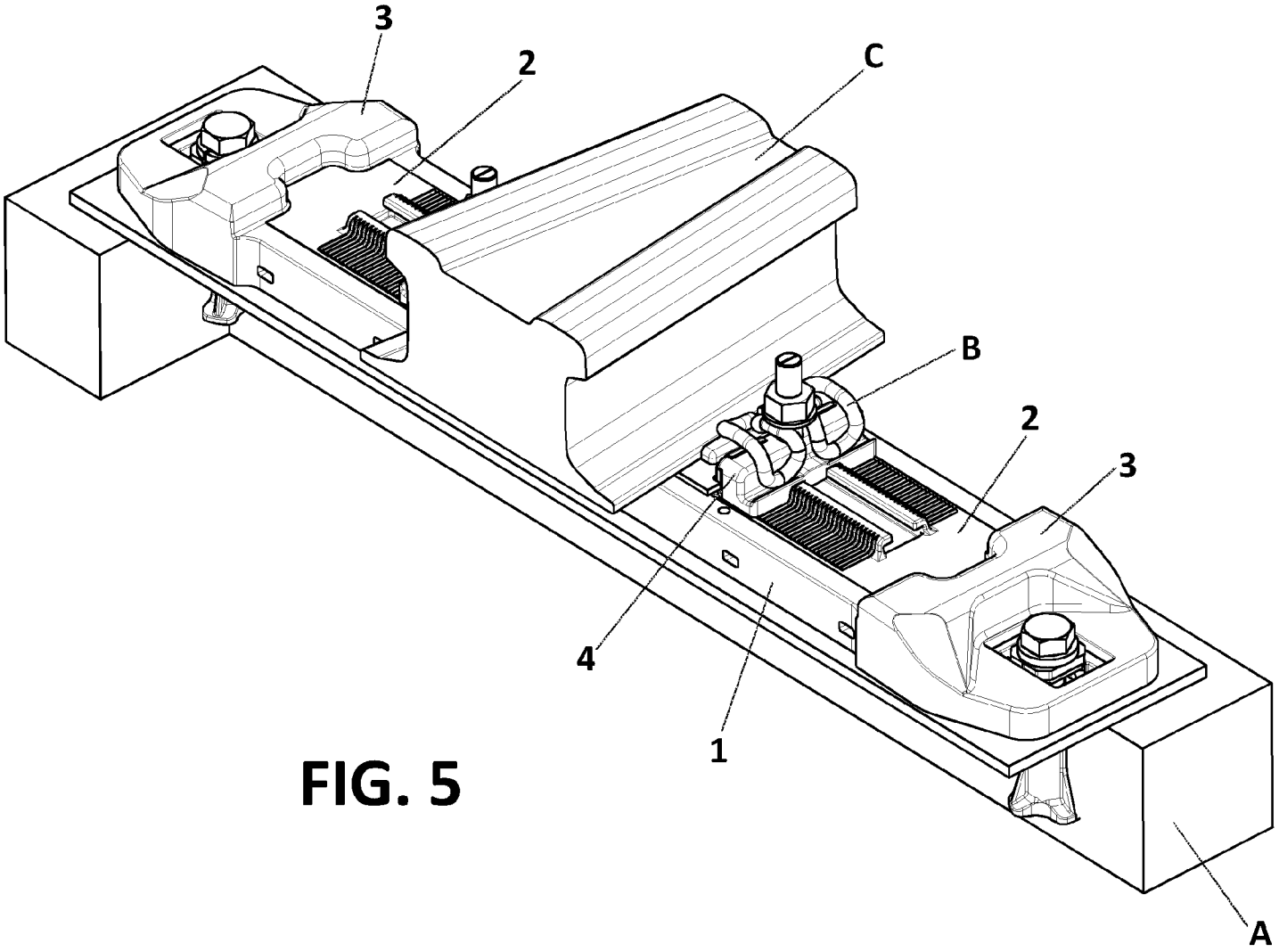
FIG. 5 shows a schematic perspective view such as that of FIG. 4 in which a rail corresponding to the track frog has additionally been depicted.

On one hand, according to FIG. 4 it is contemplated for the smooth central segment (2') of the upper plate (2) to comprise on the upper portion thereof a base plate (6) for the rail (C), where said base plate (6) comprises two larger sides and two smaller sides, the length of each of the larger sides coinciding with the length of the smooth central segment (2') of the upper plate (2).

Figure 6:
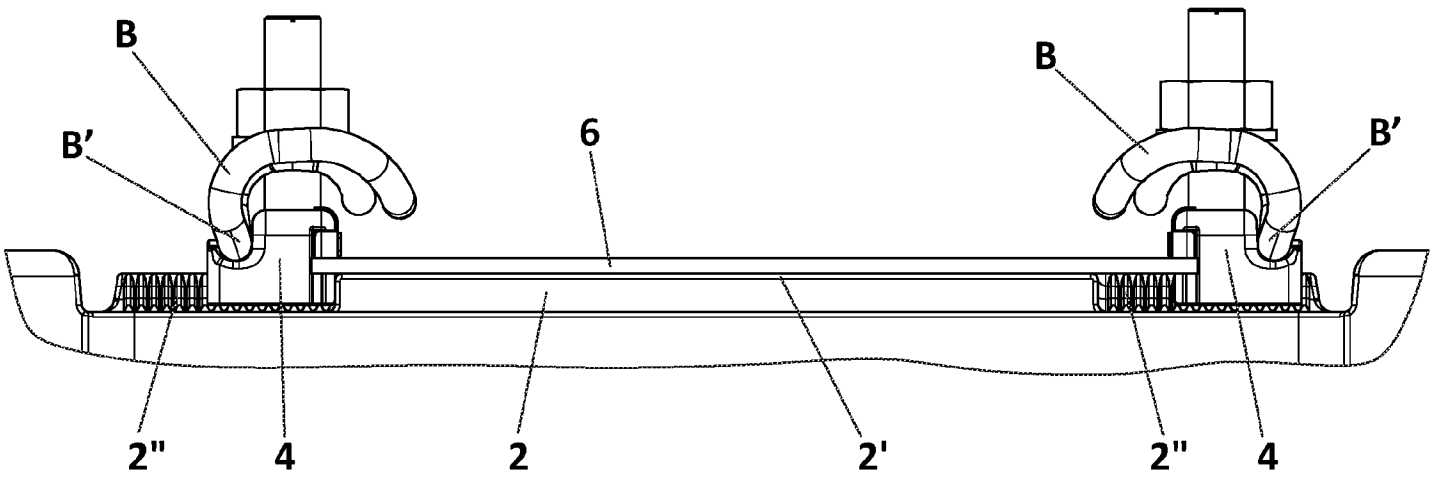
FIG. 6 shows an elevational perspective view of the fastening of the invention, in which the housing of the elastic clips in the housings comprised in the inner shoulders can be seen in particular.
Figure 7:
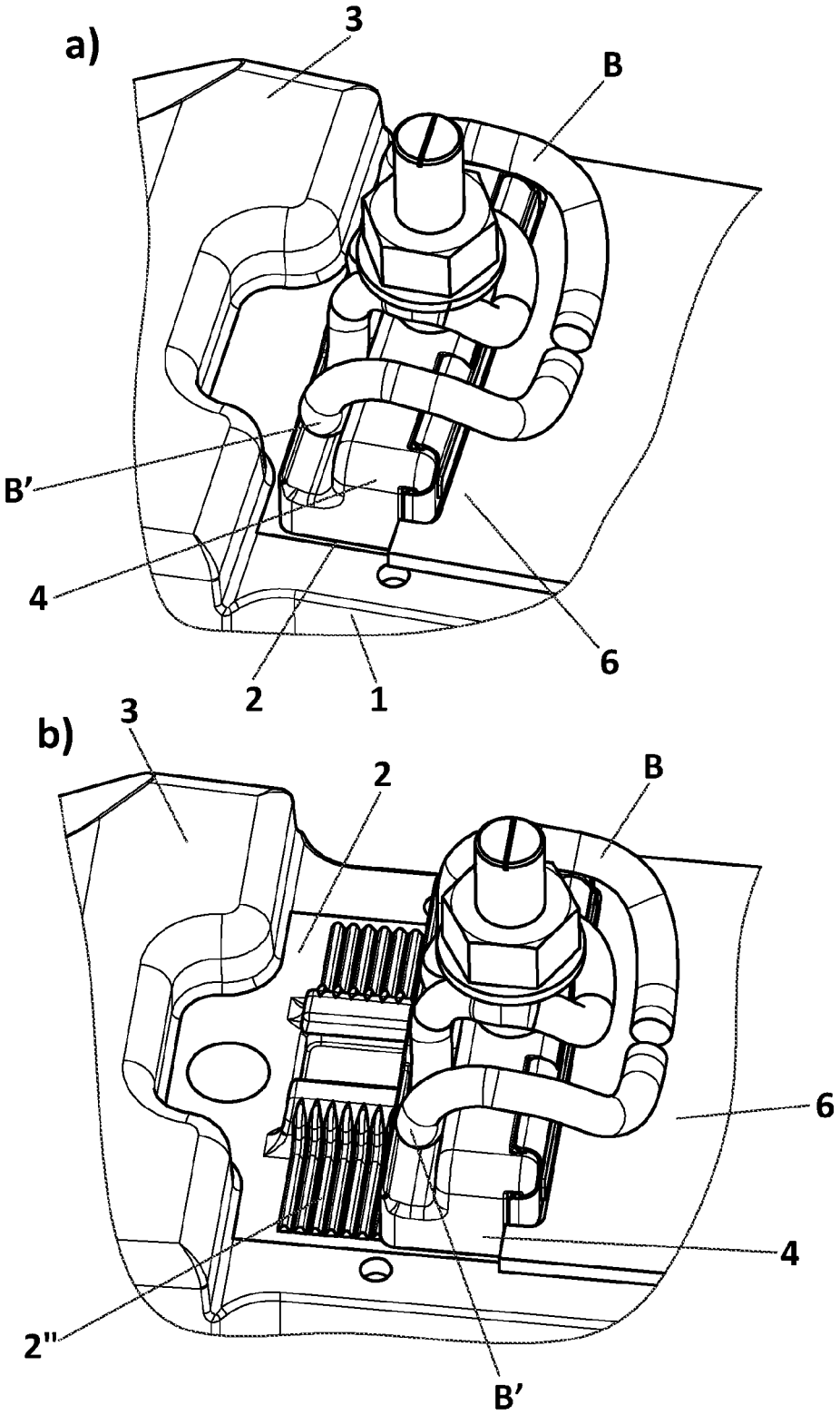
FIG. 7 shows two schematic perspective details of the area corresponding to one of the inner shoulders which in FIG. 7*a*) has been depicted in a position in which the distance between said inner shoulders is maximized, whereas in FIG. 7*b*), said distance is reduced with respect to the position depicted in FIG. 7*a*).

On the other hand, according to FIG. 6 it is contemplated for the smooth central segment (2') of the upper plate (2) to comprise on the upper portion thereof a base plate (6) for the rail (C), where said base plate (6) comprises two larger sides and two smaller sides, the length of the smooth central segment (2') being smaller than the length of each of the larger sides of the base plate (6), even allowing the upper base plate (6) not to be centered with respect to the smooth central segment (2'), providing greater variability in terms of being adapted and adjusted to the track requirements.

In both cases, the smaller sides of the base plate (6) are drawn in with respect to the larger sides, defining respective fitting areas with respect to each of the inner shoulders (4).

FIG. 3*b*) shows that the means for housing the elastic clip (B) comprise a longitudinal cavity (7) made on one side of the inner shoulders (4) for supporting the curved outer areas (B') of the elastic clip (B), a central raised area (8) in said longitudinal cavity (7) separating the curved outer areas (B') serving as a lateral stop for the outer areas, as well as a central through hole (9) for the screw for fastening the elastic clip (B) to the rail (C) and the actual inner shoulder (4) to the upper plate (2).

Figure 8:
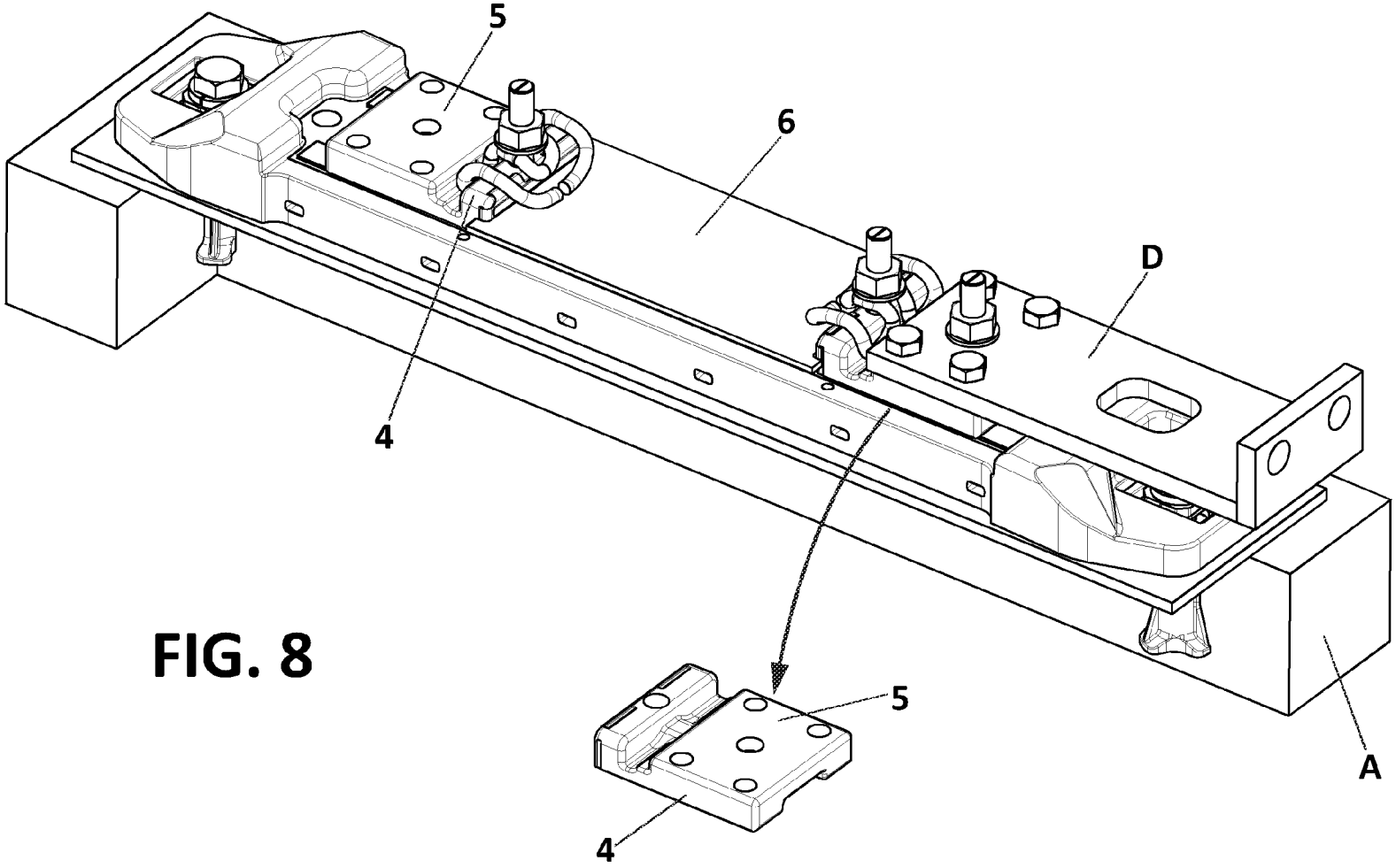
FIG. 8 shows a schematic perspective view of an embodiment variant of the inner shoulder comprising a second or prolongation surface for a rolled iron or steel plate.

On the other hand, FIG. 8 depicts an embodiment in which the inner shoulders (4) comprise a prolongation surface (5) which allows fastening a rolled iron or steel plate (D) to the inner shoulder (4) itself.

The invention claimed is:

1. A modular fastening for track crossings, comprising:

a lower plate on which there is placed an upper plate, and an outer shoulder, located at each end of the plates, comprising means for anchoring the fastening on a support surface, wherein:

the plates and the outer shoulders are attached to one another by an adhesive, thereby forming a single-block assembly, the upper plate comprises a smooth central segment located between two grooved areas located in correspondence with the ends of the upper plate, the fastening comprising two inner shoulders comprising lower grooves which can engage and fit into a plurality of positions on the grooved areas of the upper plate, where said inner shoulders comprise means for housing and securing an elastic fastening clip for fastening a railway rail; and wherein the upper plate further comprises a longitudinal channel running from one grooved area to the opposite grooved area and passing through the smooth central segment, where the inner shoulders in correspondence with the lower grooves comprise a guide bridge-like channel.

2. The modular fastening according to claim 1, wherein the lower plate and upper plate are metal plates.

3. The modular fastening according to claim 1, wherein the guide bridge-like channel of each inner shoulder comprises a lower projection which can be housed in and moved in a guided manner along the longitudinal channel of the upper plate.

4. The modular fastening according to claim 1, wherein the smooth central segment of the upper plate has a height greater than the height of the grooved areas.

5. The modular fastening according to claim 1, wherein the smooth central segment of the upper plate comprises on the upper portion thereof a base plate for the rail, where said base plate comprises two larger sides and two smaller sides, the length of each of the larger sides coinciding with the length of the smooth central segment of the upper plate.

6. The modular fastening according to claim 5, wherein the smaller sides of the base plate are drawn in with respect to the larger sides, defining respective fitting areas with respect to each of the inner shoulders.

7. The modular fastening according to claim 1, wherein the smooth central segment of the upper plate comprises on the upper portion thereof a base plate for the rail, where said base plate comprises two larger sides and two smaller sides, the length of the smooth central segment being smaller than the length of each of the larger sides of the base plate.

8. The modular fastening according to claim 1, wherein the means for housing the elastic clip comprise a longitudinal cavity made on one side of the inner shoulders for supporting the curved outer areas of the elastic clip, a central raised area in said longitudinal cavity separating the curved outer areas and acting as a lateral stop for said outer areas, and a central through hole for the screw for fastening the elastic clip to the rail and the actual inner shoulder to the upper plate.

9. The modular fastening according to claim 8, wherein the inner shoulders comprise a prolongation surface which allows fastening a rolled iron or steel plate to the inner shoulder itself.

* * * * *